US005362130A

United States Patent [19]

Hoffman

[11] Patent Number: 5,362,130

[45] Date of Patent: Nov. 8, 1994

[54] COLLAPSIBLE COMPACT CHAIR WITH BACK SUPPORT FOR BACK-PACKING OUTDOORS USE

[76] Inventor: Timothy C. Hoffman, 104 44th St., Manhattan Beach, Calif. 90266

[21] Appl. No.: 188,921

[22] Filed: Jan. 31, 1994

[51] Int. Cl.[5] ..... A47C 7/00

[52] U.S. Cl. ..... 297/440.11; 297/16.2; 297/17; 297/45

[58] Field of Search ..... 297/16.2, 17, 45, 440.11, 297/440.12, 440.1, 440.16, 440.21, 452.13

[56] References Cited

U.S. PATENT DOCUMENTS

| | | | |
|---|---|---|---|
| 4,671,566 | 6/1987 | Knapp et al. | 297/440.11 X |
| 4,673,211 | 6/1987 | Hoffman | 297/16.2 |
| 5,016,792 | 5/1991 | Jay | 297/17 X |
| 5,205,610 | 4/1993 | Reninger | 297/17 X |

FOREIGN PATENT DOCUMENTS

| | | | |
|---|---|---|---|
| 139306 | 5/1985 | European Pat. Off. | 297/45 |

*Primary Examiner*—Laurie K. Cranmer
*Attorney, Agent, or Firm*—Monty Koslover Assoc.

[57] ABSTRACT

A lightweight, collapsible compact chair with back support for outdoor backpacking use is described. The chair is an improvement in stability and weight to a prior art compact chair disclosed in U.S. Pat. No. 4,673,211. The improved chair version comprises a triangular sling fastened to the ends of three frame support members which are joined to form an inverted wye for placing on the ground. The two front support members are angled 90 degrees apart for optimum seated stability. A removable backrest is placed against the top of the sling and held by an adhesive. Each of the three frame support members may be easily connected or disconnected without need of screws or clamps. When placed closely together for packing together with the sling, the package weighs less than 24 ounces, which is very suitable for back-packing.

2 Claims, 2 Drawing Sheets

COLLAPSIBLE COMPACT CHAIR WITH BACK SUPPORT FOR BACK-PACKING OUTDOORS USE

BACKGROUND AND SUMMARY OF THE INVENTION

This invention relates to chairs for back-packing, camping and other outdoors use, and more particularly to a lightweight, compact collapsible chair with back support capable of being easily disassembled and carried.

The invention is considered to be an improvement on a lightweight compact chair previously patented (U.S. Pat. No. 4,673,211) and produced by the applicant. In U.S. Pat. No. 4,673,211, which is hereby incorporated by reference, the compact chair comprises a triangular sling, a frame supporting the sling and a backrest. The frame comprises three tubular support members joined by a hinged device, so that the front two of the support members can be folded against a back member for packing. The two front support members form a "Vee" approximately 55 degrees spread apart on the ground for support. The back support member angles backwards to support the back of the seated person.

Over the years since the original compact chair per U.S. Pat. No. 4,673,211 was first produced and used by back-packers and campers, it has been observed that the chair has a slight tendency to tip if the seated person leans heavily to a side. This is due to the relatively small angle of 55 degrees by which the front two support members are spread apart on the ground. Tipping occasionally occurs in spite of the side tabs which were added to the base of the frame in order to counter tipping tendencies. In addition, although the frame is lightweight, every ounce of added weight counts in back-packing and if the frame could be lightened, it should be done. It is therefore apparent that stability and weight improvements to the device are warranted by experience.

As an improvement, it was determined to spread apart the two front frame members by an angle of 90 degrees, providing thereby an excellent seated stability. In addition, the original bracket support mechanism was greatly simplified, deleting the folding mechanism and reducing the overall weight significantly.

The improved chair invention thus comprises a triangular sling which is fastened to the ends of three frame support members which are joined to form an inverted wye for placing on the ground. The two front support members are angled 90 degrees apart for optimum seated stability. A removable backrest is placed against a T-section located at the top of the rear frame support member, and held in place by a portion of the sling. Each of the three frame support members may be easily connected or disconnected without need of screws or clamps, and placed closely together for packing and carrying.

Accordingly, it is a prime object of this invention to provide a compact chair with back support which is very stable when a person is seated in the chair, with minimum tendency to tip sideways.

Another object is to provide a comfortable chair that weighs significantly less than the prior invention compact chair and has a minimum number of parts, presenting a light burden for back-packers or similar users.

Yet another object is to provide a chair with back support which is simple in construction and manufacture.

DESCRIPTION OF THE PREFERRED EMBODIMENT

Figure 1:
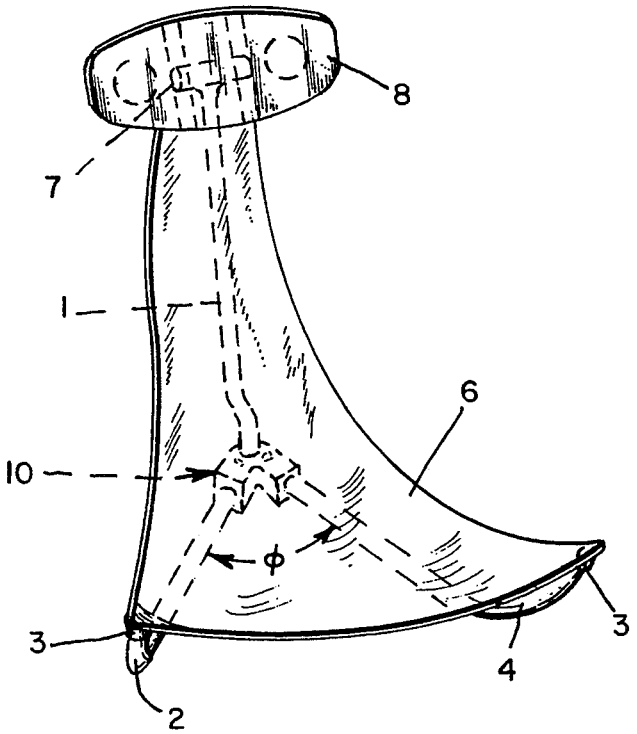
FIG. 1 is a perspective view showing the preferred embodiment of the present invention and illustrating the chair set up for use.

Referring particularly to the drawings, there is shown in FIG. 1 a perspective view of a preferred embodiment of the present invention compact chair, assembled and set up for use. Because of the chairs' small size, it has been referred to as a "pocket lounger". It is sized to accommodate comfortably a typical male or female adult and is not intended for children, although of course it may be used by children. The chair over all weight is less than 24 ounces. It is entirely collapsible into its component parts for easy packaging and carrying.

The chair includes a back frame member 1, two front frame members 2, 4, a sling 6 and a backrest 8. For assembly, the two front frame members 2, 4, are snapped into holes in the base of the back frame member 1, thus forming the chair frame support. The assembled chair frame has the back frame member 1 projecting upwards and inclined backwards, and the two front frame members 2, 4, on the ground plane, forming a Vee angle $\Phi$ of approximately 90 degrees apart. This angle of separation has been found to achieve optimum stability for the chair support base.

The backrest 8 is attached by an adhesive such as "VELCRO" to the top front of the sling 6 and the sling corners are placed over the projecting ends of the assembled frame. Thus assembly or disassembly is simple and quick.

The sling 6, is triangular in shape and may be of any suitable material such as canvas providing only that it be strong enough to support an adult human weight. The sling 6 includes pockets sewed in its top end to fasten over the top of the back frame member 1. Also included in the sling are pockets located at its two remaining corners for fitting over the ends of the two front frame members, providing support for the sling 6. It is not essential that pockets be formed in the sling 6 for fastening to the frame members. Any suitable fastening capable of securing the sling in place may be used.

The backrest 8 is essentially the same as that described in U.S. Pat. No. 4,673,211. It is an oval shaped piece of stiff aluminum sheet, covered with a soft, padded material for the user's comfort. Large holes are cut in the aluminum sheet to lighten the backrest weight.

Figure 2:
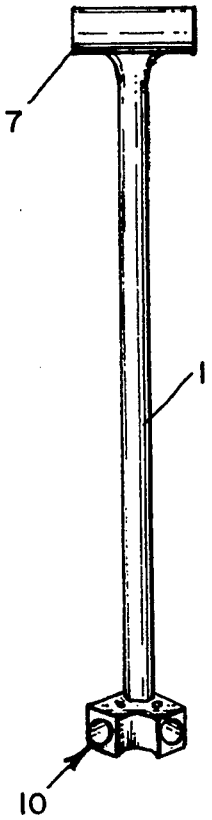
FIG. 2 is an front elevation view of the back frame support member.
Figure 3:
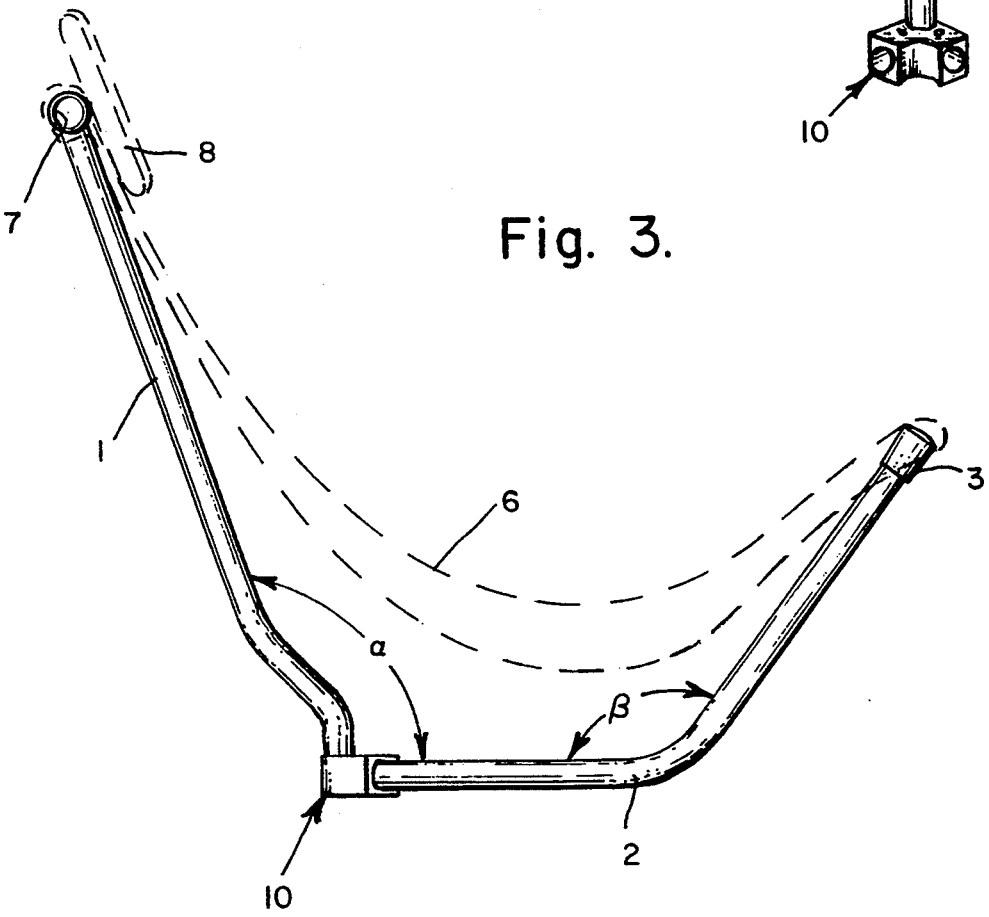
FIG. 3 is a side elevation view of the assembled frame of the present invention device, showing also the location of the sling and the backrest.

Refer now to FIGS. 2 and 3 which are respectively, a front elevation view of the back frame member 1 and a side elevation view of the assembled chair frame. The back frame member 1 comprises three parts which are joined together: a long tubular member, a short metal member 7 and a solid metal bracket 10. The short member 7 is welded to the top end of the long tubular member so that it is at 90 degrees to the tubular member and forms a "T". The metal bracket piece 10 is fastened to the distal or lower end of the tubular member and is not intended to be removed. The long tubular member is bent near to its lower end in a manner such that, when fastened to the metal bracket piece 10, the tubular member, which will support the back of a seated person, is at an approximate angle $\alpha$ of 105 degrees with the base ground plane of the bracket piece 10. According to the design literature "Furniture And Appliance Design", it is desirable for good posture, that the angle between the seat pan and the seat backrest must be approximately 105 degrees to keep the torso against the backrest and yet not force the occupant to lean his or her head forward to balance properly. The proper back support angle $\alpha$ is therefore an important aspect of the chair design and is strictly observed here.

Referring once more to FIG. 3, it is seen that a portion of each front frame member 2, 4 is bent to form an angle $\beta$ with its ground plane of approximately 125 degrees. This permits the frame member ends 3 to be properly positioned for supporting the sling 6 while still allowing sufficient frame on the ground as a base. It should be noted that this configuration frame member 2 is actually shorter in tubular length than the equivalent front support (frame) members described in the prior patent chair (U.S. Pat. No. 4,673,211), although the new chair seat area provided is wider. This is due to the 90 degree angle between the front members as compared with the original 55 degree angle. The result is that more weight is saved, producing a lighter chair.

Figure 4:
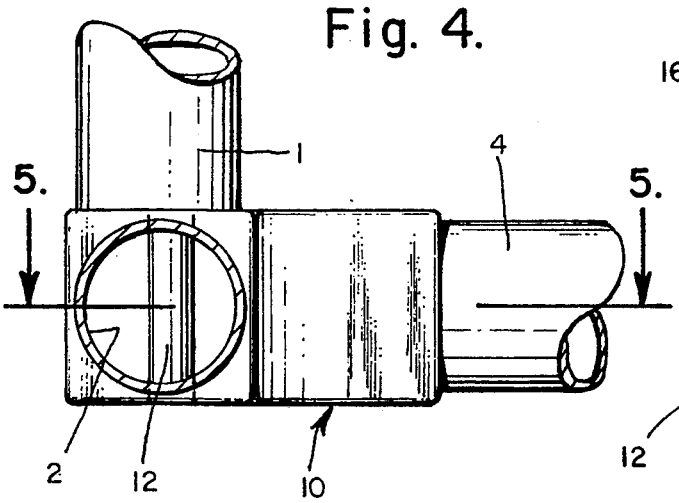
FIG. 4 is a side elevation view of the bracket support showing partial views of the tubular frame members which are inserted in the bracket.
Figure 5:
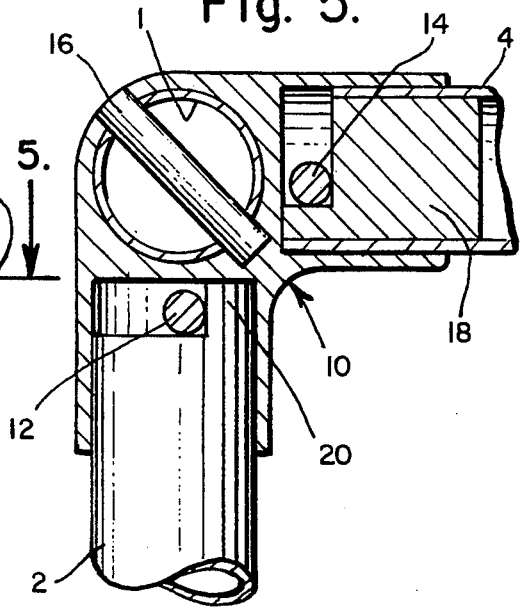
FIG. 5 is a cross-section plan view of the bracket support and inserted tubular frame members taken along line 5—5 of FIG. 4, and particularly illustrating the means used for preventing rotation of the tubular frame members.
Figure 6:
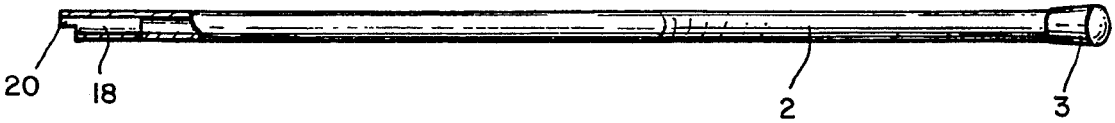
FIG. 6 is a plan view of a front frame support member, particularly showing its straight aspect and the stepped plug inserted in one end to prevent rotation of the member when assembled.

Refer now to FIGS. 4, 5 and 6 which show detail of the bracket 10 construction and one of the two front frame members 2. FIG. 5 is a cross-section view taken along plane 5—5 of FIG. 4. The bracket 10 is a 90 degree metal elbow having flat opposing outer surfaces. Holes are bored horizontally in the two bracket 90 degree separated portions to accommodate the ends of the front frame members 2,4. A third hole is bored vertically, normal to the base plane of the bracket 10 to accommodate the tubular member back piece 1. A pin 16 is passed through the bottom of the back member 1, fastening it in place in the bracket.

Means are provided to prevent rotation of the two front frame members and to ensure that they are assembled in place correctly. The preferred means comprises a stepped plug 18 which is inserted and fastened in the end 20 of each of the front frame members 2, 4, interacting with a pin 12, 14 which is located vertically through each leg of the bracket 10. The pins 12, 14 and the step of each plug 18 are set off center of the holes and member tubes, producing a keyed fit and ensuring that the ends 20 of the front frame members 2,4, can only be inserted in the bracket 10 tube holes in the correct rotated position, with the bent portions pointing upwards. The fit of the tubular frame members in the bracket is of close tolerance, so that the assembled three parts of the frame are fairly rigid. This contrasts with the prior invention chair where some slight flexing occurred due to tolerance built up in the relatively complex bracket folding mechanism.

As shown in FIGS. 3 and 6, a cap 3 is placed tightly on the free end of each of the two front frame members 2,4, so that the frame member ends can be inserted in the corner pockets of the sling 6 for assembly.

Figure 7:
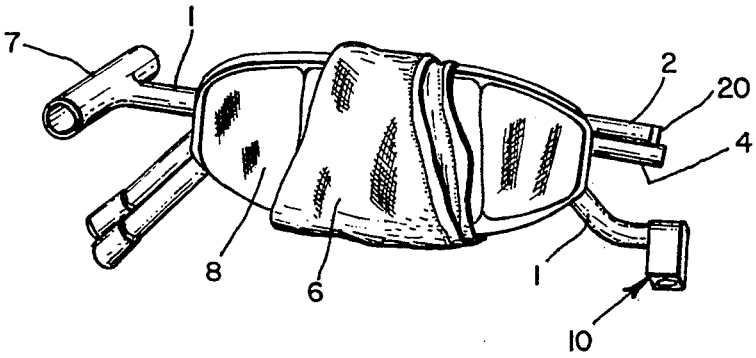
FIG. 7 is a perspective view of the compact chair, disassembled and wrapped in the sling, forming a compact package for back-pack carrying.

Finally, FIG. 7 shows the device packaged with the sling 6 and backrest 8 wrapped around the three separated frame members 1,2,4. In this packaged configuration, the packaged disassembled chair is convenient to tie on to a back pack and weighs less than 24 ounces, which is very light for a wide, comfortable chair.

The advantages of this improved version chair over the original "pocket lounger" folding camp chair described in U.S. Pat. No. 4,673,211 are as follows:

1. Increased seated stability—The wider separation angle of the front frame members greatly increases the sideways seated stability over the prior version chair.
2. Increased packaging compactness—In the new design, the frame is disassembled and the frame members can be placed very close together, making the package very compact.
3. Less weight—The new design requires less tubing and parts to produce the chair, and as a result presents a significant weight saving over the prior version chair of the same seating surface.
4. Easier to manufacture—The reduced complexity, particularly of the bracket support, makes the new chair easier and less costly to make.

From the foregoing description, it is clear that the preferred embodiment achieves the objects of the present invention. Alternative embodiments and various modifications may be apparent to those skilled in the art. These and other alternatives are considered to be equivalent and within the spirit and scope of the present invention.

Having described the invention, what is claimed is:

1. A lightweight, collapsible compact chair for outdoors use by adults, the chair comprising:

(a) a three-part metal support frame; said frame comprising a back support member and two front support members loosely joined together by fit at one end and forming an inverted wye shape; said back support member being angled backwards and upwards at an angle of approximately 105 degrees to a ground plane to provide required sitting posture for a seated person; said front support members having an angle of approximately 90 degrees between them in the ground plane to provide seat support stability and to prevent tipping; said front support members each having a portion of their free end length bent upward and outward at an approximate angle of 125 degrees, providing front projecting ends for supporting a sling;

(b) a triangular sling which is attached at its three corners to the top of said frame back support member and to said frame front projecting ends; said sling being fabricated of canvas material; said sling incorporating means for being temporarily fastened to said back support member and to said frame front projecting ends; and (c) a backrest which is attached to the top portion of said sling; said backrest being made of aluminum metal sheet, elliptical in shape and of sufficient width to provide support to the back of a human adult; said metal sheet being covered with a padding material for comfort;

said back support member comprising a long aluminum tubular member having a short metal member welded to one end forming a T shape at its top, and a bracket fastened to the distal end of said tubular member; said bracket being a metal block elbow having flat surfaces on all its sides, said elbow having a first socket hole bored in the axis of one of its 90 degree arms and a second socket hole bored in the axis of its other 90 degree arm, each said first and second socket hole being sized to fit snugly over the end of a front support member when said frame is assembled; said elbow having a third socket hole bored vertically at its center corner, normal to the plane of said 90 degree arms, said third socket hole sized to fit snugly over the inserted fitted free end of said long aluminum tubular member; said elbow including a metal pin which is inserted horizontally through a hole in the side of said elbow and through a hole in said fitted tubular member, firmly fastening said tubular member to said bracket; said collapsible compact chair capable of being disassembled into three separate frame parts and a sling forming a very lightweight package suitable for back packing use.

2. The collapsible compact chair according to claim 1 wherein:

said back support member bracket includes means for preventing the rotation of said front support members inside said first and second socket holes; said means including a metal pin inserted vertically and set off-center through each said first and second socket hole, each said pin cooperating with a stepped plug inserted in the end of a front support member, said stepped plug being shaped and sized to only fit snugly in a first or second socket hole; said means acting to key said front support members into said socket holes in the correct attitude for assembly and assisting in making said frame rigid.

* * * * *